US006279212B1

(12) United States Patent
Balch

(10) Patent No.: US 6,279,212 B1
(45) Date of Patent: Aug. 28, 2001

(54) CREMATION AND RECORD BURIAL SYSTEM

(76) Inventor: Joseph C. Balch, 7665 Balch Wy, Salcha, AK (US) 99714

( * ) Notice: Subject to any disclaimer, the term of this patent is extended or adjusted under 35 U.S.C. 154(b) by 0 days.

(21) Appl. No.: 09/393,196

(22) Filed: Sep. 10, 1999

Related U.S. Application Data

(60) Provisional application No. 60/115,694, filed on Jan. 11, 1999.

(51) Int. Cl.[7] ..... A61G 17/00

(52) U.S. Cl. ..... 27/1; 27/35; 52/136; 52/128

(58) Field of Search ..... 27/1, 35; 220/4.27; 52/128, 133, 134, 136

(56) References Cited

U.S. PATENT DOCUMENTS 2,326,414 * 8/1943 Thompson .
2,488,611 * 11/1949 Stallings .
2,663,450 * 12/1953 Bourcart .
3,529,730 * 9/1970 Thompson .
3,898,718 * 8/1975 Eubank .
4,328,606 * 5/1982 Nunes .
4,697,316 * 10/1987 Semon .
4,893,385 * 1/1990 Schrag .
4,977,652 * 12/1990 Graham .
5,208,957 * 5/1993 Hereford .
5,379,499 * 1/1995 Jackson .
5,729,921 * 3/1998 Rojas .
5,815,897 * 10/1998 Longstretch .
6,023,822 * 2/2000 Luebke .
6,167,600 * 1/2001 Williams et al. .

* cited by examiner

*Primary Examiner*—B. Dayoan
*Assistant Examiner*—William L. Miller
(74) *Attorney, Agent, or Firm*—Michael J. Tavella

(57) ABSTRACT

A two-piece container for burial of a deceased's remains and personal artifacts. A first container holds the deceased's remains. A second container holds the papers and belonging's that document that person's life. A cylindrical, waterproof tube of metal or plastic holds the two containers when they are buried. Typically, the tube is placed vertically in the ground, with the top portion exposed. The tube can vary in length, thereby allowing more than one set of containers to be buried in a given location. This system has several advantages: less space is needed to bury an entire family; and the tubes can be installed before death making winter burials less of a problem. The cap of the tube can be protected and a headstone can be placed at the site. The cap can be made accessible so that it can be opened as needed to bury another person, or to obtain access to records as needed.

13 Claims, 3 Drawing Sheets

CREMATION AND RECORD BURIAL SYSTEM

CROSS REFERENCE TO RELATED APPLICATIONS

This application claims the benefit of U. S. Provisional Application No. 60/115,694, filed Jan. 11, 1999

STATEMENT REGARDING FEDERALLY SPONSORED RESEARCH AND DEVELOPMENT

Not Applicable

BACKGROUND OF THE INVENTION

1. Field of the invention

This invention relates to burial systems for cremated remains, and particularly to burial systems for cremated remains, that have the capacity for integral record storage.

2. Description of related art

Burial systems have been developed in ancient times, for millennia, people have taken steps to preserve the dead and information related to them. Perhaps the most extensive systems for both burial and record keeping is that of the ancient Egyptians, who not only preserved the body, but included elaborate records in the tombs of their people. Since that time, the burial process has been greatly simplified. Today, the dead either are buried in caskets, or are cremated. The cremated remains may be buried, kept in above ground repositories, or are otherwise handled. Although these methods work well, there is no convenient way to preserve the remains and historic and personal information about the deceased when the remains are buried or kept in a cemetery.

BRIEF SUMMARY OF THE INVENTION

The instant invention is a two-piece container. The first container holds the deceased's remains. The second container holds the papers and belonging's that document that person's life. Such items as birth certificates, marriage certificates, family photographs, a lock of hair, or other sources of DNA, and other memorabilia are placed in the second container. This container is then sealed with paraffin wax, or a similar substance.

A cylindrical, waterproof tube of metal or plastic holds the two containers when they are buried. Typically, the tube is placed vertically in the ground, with the top portion buried a few inches below the surface. The tube can vary in length, thereby allowing more than one set of containers to be buried in a given location. Thus, an entire family may be buried in a single tube, with the containers being stacked within the tube.

This system has several advantages. First, much less space is needed to bury an entire family as compared to the present method of burial. Second, the tubes can be installed in advance of death. Once in place, the tubes are sealed until needed. The tubes are accessible year round. This allows burials in winter in northern areas instead of deferring burials to the warmer months. Allowing for timely burials helps the grieving process.

If the ground is frozen, the tubes can be installed using an auger. Boring a hole can be done in rock, or frozen ground with much less problem that a regular burial. The cap of the tube can be protected and a headstone can be placed at the site. The cap can be made accessible so that it can be opened as needed to bury another person, or to obtain access to records as needed.

DETAILED DESCRIPTION OF THE INVENTION

Figure 1:
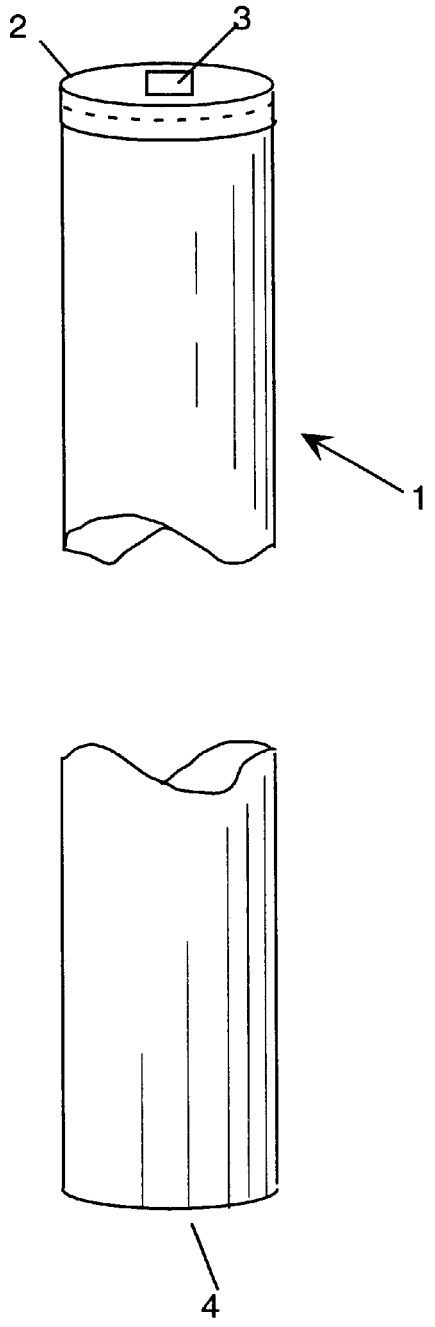
FIG. 1 is a perspective view of the outer burial tube.

Referring now to FIG. 1, the outer burial tube 1 is shown. This tube is a long hollow tube similar to a pipe casing. It may be made of metal or plastic. It is a waterproof container that is designed to have a very long life. The tube 1 has an open top that is sealed with a removable cap 2. In the preferred embodiment, the cap is screwed on to the tube 1 using standard threads. The cap 2 has a small recess 3 in it to receive a wrench to tighten or remove the cap. The burial tube may be placed in the ground vertically at any time. The tube is designed to hold the remains and artifacts of deceased family members. Because the cap 2 is removable, these remains can be added at any time. Moreover, as discussed below, access to the remains or artifacts may be obtained at any time. Finally, the tube 1 can be any length. This allows for the placement of several remains packages in one tube. Note that the tube is completely sealed at the bottom with a solid member 4 as shown.

Figure 2:
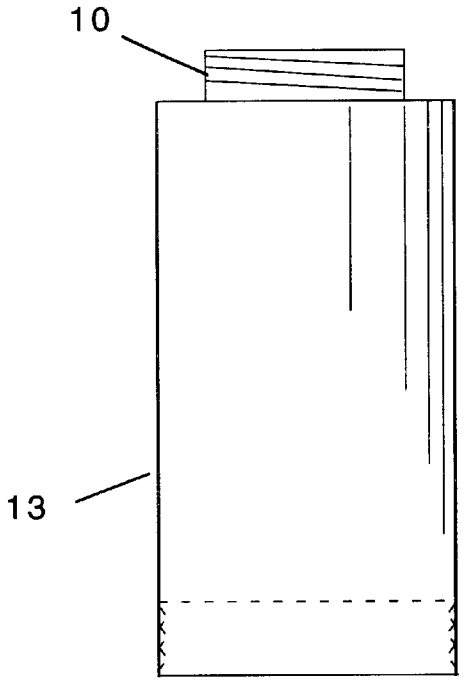
FIG. 2 is a side view of the ash container.
Figure 3:
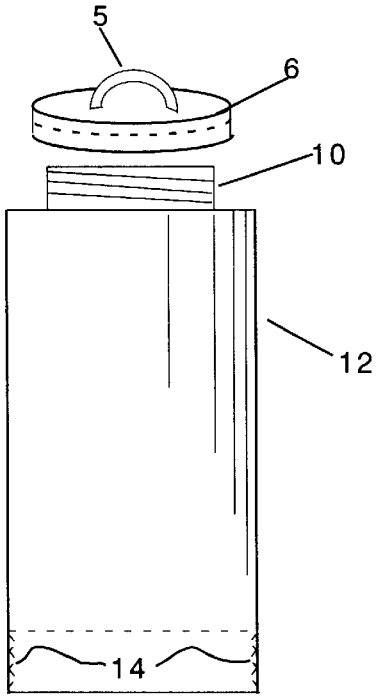
FIG. 3 is a side view of the information storage container.

FIGS. 2 and 3 shows the containers that are placed within the burial tube 1. FIG. 2 is a side view of an ash container 13. The cremated remains are intended to be placed in this container. The container has a sealed bottom 14 that is recessed as shown. The recess allows to top of another container to be placed inside the base when the units are stacked. The recess also has threads 16 that permit a lower container to be screwed onto the container 13. These features are described in more detail below.

The top of the container is threaded with threads 10 as shown. These threads are designed to engage threads 14 in the upper container 12. This is discussed below.

FIG. 3 shows the time capsule, or artifact container 12. This container is similar in shape and size to the ash container. The artifact container 12 has a recessed bottom and a threaded base, as shown. This allows the artifact container to be screwed down onto the top of the ash container. This then creates a single unit that contains the remains of the deceased and a container full of artifacts that relate to the deceased. The top of the artifact container is sealed to prevent leaks. Then a cover 6 is screwed in place. A lift ring 5 is attached to the cover as shown. This allows the container combination to be placed in the burial tube, or removed from the tube as desired. Note that the recessed base in the ash container is designed to accommodate the lift ring when several containers are stacked in one tube.

Figure 4:
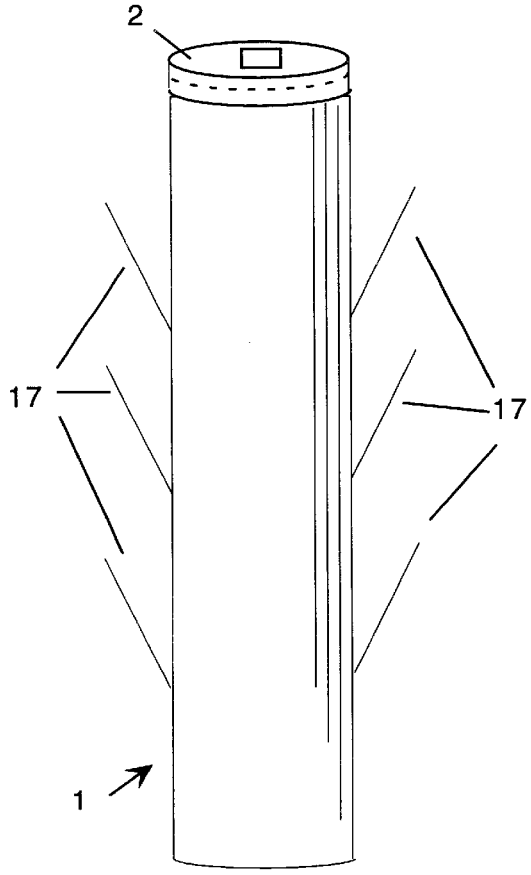
FIG. 4 is s side view of the tube showing holding fingers installed, to prevent easy removal of the tube.

FIG. 4 shows the burial container 1 with a number of folding gripping FIG. 17 FIG. 4 shows five fingers extended and one folded up against the tube. These fingers are an option used in areas of unstable soils. Once the tube is set in place, any upward pushing of the ground causes the fingers to expand and dig into the soil, making further uplift difficult.

Figure 5:
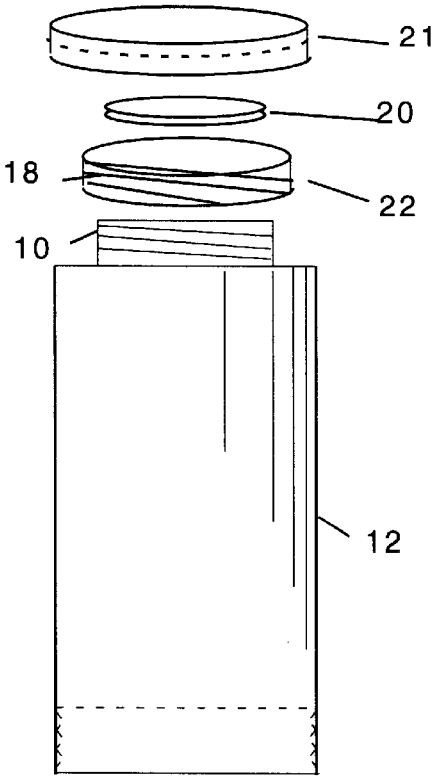
FIG. 5 is a side view of the information storage container with an alternative retrieval system.

FIG. 5 shows an alternative lifting mechanism for the artifact container 12. Here, an inner lid 18 is placed over the threads 10 as before. In this embodiment, there is no lift ring 5. A magnet 20 is placed on top of the inner lid 18. An outer lid 21 is then screwed down onto the inner lid 18 using threads 22 formed on the inner lid. The outer lid can be made of plastic or metal as desired.

Figure 6:
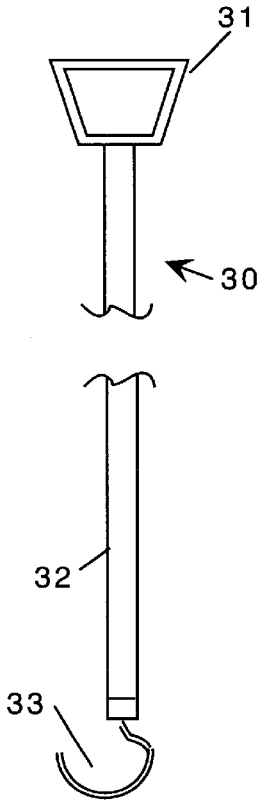
FIG. 6 is a detail view of a first retrieval tool.
Figure 7:
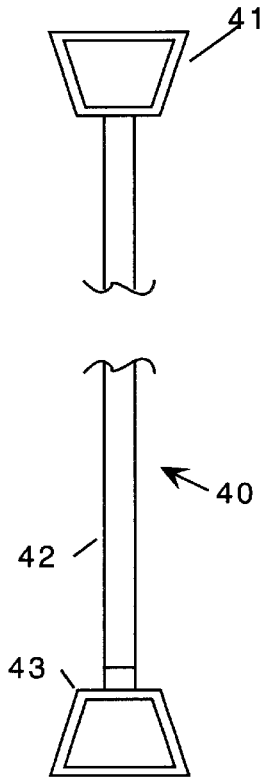
FIG. 7 is s a detail view of a second retrieval tool.
Figure 8:
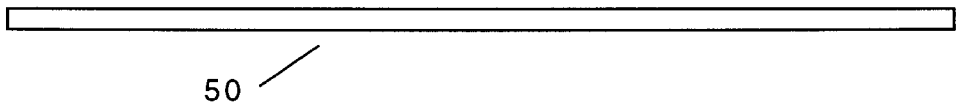
FIG. 8 is a side view of a push rod used with the second retrieval tool.

FIG. 6 shows a first type of lifting tool 30. This tool has a handle 31, a long shaft 32, which may be telescoping, and a hook 33. This tool is used to lift the lift ring 5 to lift the containers from the tube or to place them for burial. FIG. 7 shows a second type of lifting tool 40. This tool has a handle 41, a long shaft 42, which may be telescoping, and a magnetic base 43. This tool is used to engage the magnet 20, when used in that embodiment, to lift the containers from the tube or to place them for burial. To place the containers into the tube, a push rod 50 is needed. The push rod is shown in FIG. 8. Once the containers are in place, the push rod 50 is placed into the tube against the top of the plastic lid. The push rod holds the containers in the tube until the magnet can be pulled from the plastic lid 21 and removed. Once the tools are removed, the tube is sealed, covered and marked in the manner discussed above.

The tubes are buried with the tops a few inches below grade. The rest of the hole is then filled with a non-frost susceptible material, so that access to the tubes is year round. A marker (not shown) can then be placed on top of the site.

As mentioned above, the tube may be buried at any time. When a family member dies, the cremated remains are placed in an ash container. Personal mementos, notes, photographs, DNA samples, and other memorabilia are placed in the artifact container and sealed. The two containers are then joined. Once joined, the containers are placed into the burial tube. As other family members die, their remains can be placed into the burial tube as well. In this way, loved ones can be interred with their memories and biological records, preserving them for future generations to examine and study.

In the preferred embodiment, the two containers use threaded fittings to join them, as well as to hold the lids in place. Of course, any other system that allows temporary joining of parts and uses removable lids may be used instead.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A system for burial of remains and artifacts comprising:

a) a burial tube, having a sealed bottom and an open top;

b) a means for temporarily sealing the open top of said burial tube;

c) a first container, sized to fit within said burial tube;

d) a means for sealing said first container;

e) a second container, sized to fit within said burial tube;

f) a means for sealing said second container;

g) a means for joining said first container and said second container such that, when connected, the first and second containers form a single unit; and h) a means for removably placing said single unit in said burial tube for internment, said means comprising a lift ring, fixedly installed on said second container.

2. The system for burial of claim 1 wherein the first container is designed to hold cremated ashes.

3. The system of burial of claim 1 wherein the second container is designed to hold a plurality of personal effects of a deceased person.

4. The system for burial of claim 1 wherein the burial tube further comprises a means for restricting movement of said burial tube when said burial tube is placed in the ground.

5. A system for burial of remains and artifacts comprising:

a) a burial tube, having a sealed bottom and an open top, said open top having a plurality of mating threads formed thereon;

b) a cover, having a set of mating threads formed thereon, whereby said set of mating threads on said cover engage the plurality of mating threads on said burial tube to attach said cover to said burial tube;

c) a first container, sized to fit within said burial tube, said first container having a bottom and a top, whereby said top of said first container has a set of mating threads formed thereon;

d) a second container, sized to fit within said burial tube, said second container having a bottom and a top, whereby said bottom of said second container has a recessed portion, designed to receive the top of said first container, and a set of mating threads formed therein, to threadably engage the top of said first container, such that when said first container is threadably engaged with said second container, the first and second containers form a single unit;

f) a means for sealing said second container; and h) a means for removably placing said single unit in said burial tube for internment comprising a lift ring, fixedly installed on said second container.

6. The system for burial of claim 5 wherein the first container is designed to hold cremated ashes.

7. The system of burial of claim 5 wherein the second container is designed to hold a plurality of personal effects of a deceased person.

8. The system for burial of claim 5 wherein the burial tube further comprises a means for restricting movement of said burial tube when said burial tube is placed in the ground.

9. A system for burial of remains and artifacts comprising:

a) a burial tube, having a sealed bottom and an open top, said open top having a plurality of mating threads formed thereon, said burial tube being designed to be buried in a vertical alignment with respect to a ground surface;

b) a cover, having a set of mating threads formed thereon, whereby said set of mating threads on said cover engage the plurality of mating threads on said burial tube to attach said cover to said burial tube;

c) a first container, sized to fit within said burial tube, said first container having a bottom and a top, whereby said top of said first container has a set of mating threads formed thereon;

d) a second container, sized to fit within said burial tube, said second container having a bottom and a top, whereby said bottom of said second container has a recessed portion, designed to receive the top of said first container, and a set of mating threads formed therein, to threadably engage the top of said first container, such that when said first container is threadably engaged with said second container, the first and second containers form a single unit;

f) a lid, removably attached to said second container, said lid further having a lifting ring attached to said lid.

10. The system of burial of claim 9 wherein the bottom of said first container has a recessed portion having a set of mating threads formed therein, whereby said set of mating threads may be used to threadably engage a top of a second single unit placed within said burial tube.

11. The system for burial of claim 9 wherein the first container is designed to hold cremated ashes.

12. The system of burial of claim 9 wherein the second container is designed to hold a plurality of personal effects of a deceased person.

13. The system for burial of claim 9 wherein the burial tube further comprises a means for restricting movement of said burial tube when said burial tube is placed in the ground.

* * * * *